United States Patent [19]

Tomura

[11] 3,952,500

[45] Apr. 27, 1976

[54] ORNAMENTAL CLOCK

[75] Inventor: Hiroshi Tomura, Tokyo, Japan

[73] Assignee: Aoki Ltd., Japan

[22] Filed: Dec. 30, 1974

[21] Appl. No.: 537,425

[30] Foreign Application Priority Data

Jan. 23, 1974 Japan ..... 49-9663[U]

[52] U.S. Cl. ..... 58/126 D; 58/152 R

[51] Int. Cl.[2] ..... G04B 19/04; G04B 45/00

[58] Field of Search ..... 58/126 R, 126 D

[56] References Cited

FOREIGN PATENTS OR APPLICATIONS 375,281 3/1964 Switzerland ..... 58/126

*Primary Examiner*—Edith Simmons Jackmon

*Attorney, Agent, or Firm*—Robert E. Burns; Emmanuel J. Lobato; Bruce L. Adams

[57] ABSTRACT

Ornamental clock having a parallelogram formed of the short and long clock hands and two sets of links pivotally linking the hands. The profile of the parallelogram changes continuously and variously as the clock hands travel about the dial plate center in order to provide a fantastic aesthetic effect to indicate time in conjunction with the time indicia.

4 Claims, 2 Drawing Figures

ORNAMENTAL CLOCK

BACKGROUND OF THE INVENTION

The present invention relates to ornamental clock, more particularly relates to an ornamental clock utilizing long and a short hands as its an ornamental elements.

It is well known that a clock has a disadvantage in that its long and a short hands function for indicating time by rotating around the dial plate center only.

SUMMARY OF THE INVENTION

The primary object of the present invention is to provide a clock with an ornamental effect by use of additional two links combined with the ordinary clock hands.

According to one aspect of a present invention, the dial plate of the clock is provided with two links, preferably coloured, one of which is as long as the short clock hand and the other of which is as long as the long clock hand. These links are pivotally joined to each other at their one ends and are pivotally joined to free ends of the long and short clock hands at the other ends in order to form a parallelogram profile, which continuously changes as the hands travel about the dial plate center to indicate time in conjunction with the time indicia.

BRIEF DESCRIPTION OF THE DRAWINGS

The invention will now be explained in more detail referring to the embodiment illustrated on the accompanying drawings in which.

DESCRIPTION OF THE PREFERRED EMBODIMENTS

Figure 1:
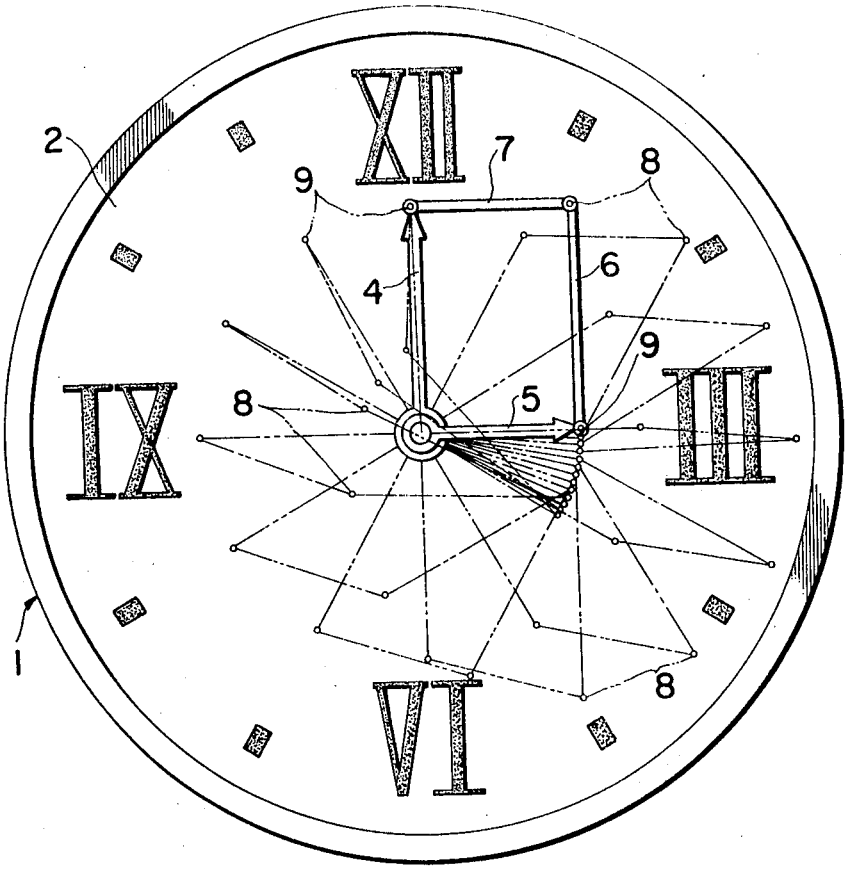
FIG. 1 is a front elevational view of one embodiment of the ornamental clock according to the present invention showing a number of parallelogram shapes formed by a set of two hands and two links corresponding each other.

In the embodiment illustrated in FIG. 1 of the accompanying drawing, the reference numeral 1 indicates a clock equipped with a long minute hand 4 and a short hour hand 5 rotating around a common axis of rotation comprising a spindle 3 located at the center of a dial plate 2 a conventional manner.

The reference numerals 6 and 7 indicate ornamental links of this invention. The length of the link 6 is identical to that of the long hand 4 and the length of the link 7 being identical to that of the short hand 5. They form parallelograms when connected to each other and operated.

These links 6 and 7 are made of a material such as light metals, synthetic resins etc. and painted in proper colors.

These links may be, if necessary, painted with fluorescent or luminous materials also in order to have an aesthentic and fascinating effect.

The reference numeral 8 indicates the pivotal joint between the links 6 and 7.

Figure 2:
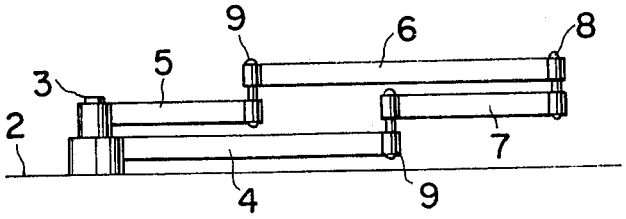
FIG. 2 is a side enlarged view of the embodiments in FIG. 1 showing two hands and two links connected to each other by means of spindle or other similar means.

The reference numerals 9, 9 (showing two portions) also indicate pivotal joints also which connect one end of the long hand 4 with one end of the short link 7 and one end of the short hand 5 with one end of the long links 6 as shown in FIGS. 1 and 2.

Being constructed as above-described, continuously changing parallelograms, as shown in broken lines in FIG. 1 can be made on the dial plate 2 of the ornamental clock of the present invention through colaboration of the two clock hands 4, 5 and the two links 6, 7 as the former rotates around the spindle 3.

The continuous variation of the parallelogram pattern formed in accordance with movement of the two hands and two links, as they are driven at the usual time-indicating speeds presents a fantastic visual pleasure in addition to indication of time.

For unique ornamental value, the ornamental clock of this invention is particularly suitable for interior decoration when hung on walls of office rooms or private rooms.

What is claimed is:

1. In a timepiece having time indicia on a face thereof, a minute hand and an hour hand shorter in length than said minute hand, said minute hand and said hour hand being driven rotationally about a common axis of rotation for indicating time in conjunction with said time indicia, said minute hand and said hour hand each having an end portion remote from said axis of rotation, a first link of a length substantially equal in length to the minute hand and having a first end portion pivotally connected to said end portion of said hour hand remote from said axis of rotation for rotation therewith, a second link of a length substantially equal in length to the hour hand and having a first end portion pivotally connected to said end portion of said minute hand remote from said axis of rotation for rotation therewith, said first link and said second link having second end portions, and means pivotally connecting said second end portions of said first link and said second link remote from said axis of rotation, whereby as the minute hand, the hour hand, the first link, and said second link are rotationally driven parallelograms of varying configuration are defined thereby.

2. In a timepiece according to claim 1, in which said hands have colored surfaces viewable in reading time.

3. In a timepiece according to claim 2, in which said links have colored surfaces viewable in reading time.

4. In a timepiece according to claim 2, in which said links and hands have colored surfaces viewable in reading time, and the color on said links being different from the color on said hands.

* * * * *